US005402936A

United States Patent [19]

Hammelmann

[11] Patent Number: 5,402,936

[45] Date of Patent: Apr. 4, 1995

[54] NOZZLE HEAD FOR ROTATING SPRAY DEVICE

[76] Inventor: Paul Hammelmann, Zum Sundern 17, 59302 Oelde, Germany

[21] Appl. No.: 162,400

[22] Filed: Dec. 3, 1993

[30] Foreign Application Priority Data

Dec. 3, 1992 [DE] Germany ..... 9216438 U

[51] Int. Cl.[6] ..... B05B 3/02

[52] U.S. Cl. ..... 239/263.1; 239/264; 239/600; 277/53

[58] Field of Search ..... 239/263, 263.1, 264, 239/600, 237, 261, 252; 277/53

[56] References Cited

U.S. PATENT DOCUMENTS

| | | | |
|---|---|---|---|
| 2,625,411 | 1/1953 | Unger | 239/261 X |
| 3,029,028 | 4/1962 | Skerritt | 239/261 X |
| 3,743,183 | 7/1973 | Malcolm | 239/264 |
| 4,715,539 | 12/1987 | Steele | 239/263 |
| 4,863,177 | 9/1989 | Rockwood et al. . | |
| 4,923,120 | 5/1990 | Hammelmann | 239/252 |
| 5,060,863 | 10/1991 | Hammelmann | 239/252 |

FOREIGN PATENT DOCUMENTS

| | | | |
|---|---|---|---|
| 3812132C2 | 8/1990 | Germany . | |
| 512656 | 9/1939 | United Kingdom | 239/261 |

*Primary Examiner*—William Grant
*Attorney, Agent, or Firm*—Darby & Darby

[57] ABSTRACT

A nozzle head includes a nozzle holder and a nozzle being disposed within the nozzle holder. A fixed housing has a pressure water fitting therein. The pressure water fitting includes a hollow shaft connected to the nozzle holder with a channel for communication of water under pressure passing entirely through it. A first insertion bushing supports a ring-shaped flange. A second insertion bushing supports a ring-shaped flange. The first and second insertion bushings are disposed in the channel of the hollow shaft along at least a part of its length such that the first and second bushings, at least in part, overlap. A split labyrinthine packing is disposed in the overlapping area between the first and second bushings.

10 Claims, 1 Drawing Sheet

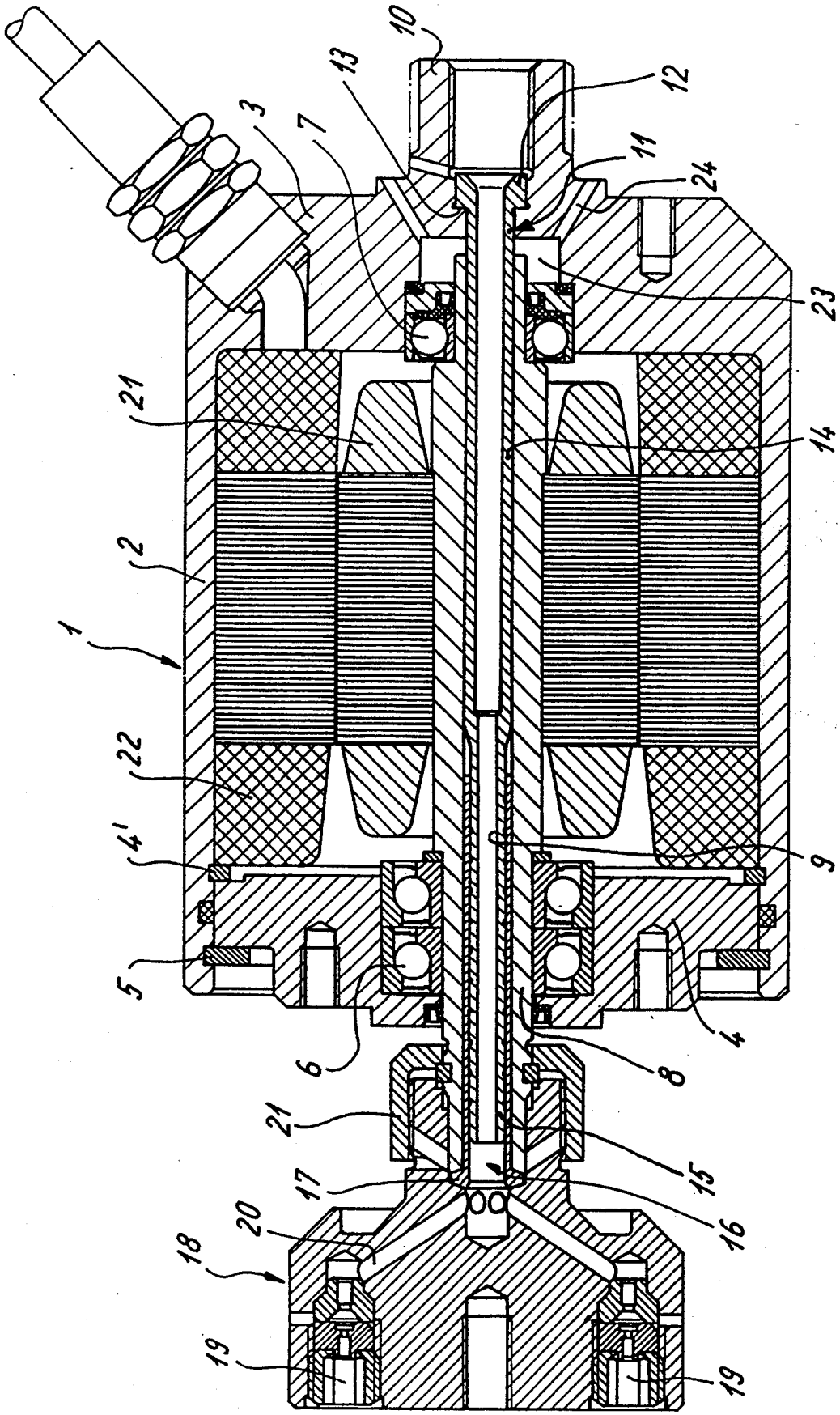
10
12
13
3
7
11
24
23
21
14
2
1
22
4'
9
5
6
8
4
21
15
17
16
20
18
19
19

NOZZLE HEAD FOR ROTATING SPRAY DEVICE

FIELD OF THE INVENTION

The present invention relates generally to a nozzle head provided with a nozzle holder. More specifically, the present invention relates to a nozzle that can be rotated around a shaft and directed at an angle with respect to the axis of rotation. A fixed housing has a pressure water fitting, in which there is a hollow shaft that is connected to the nozzle holder. A channel for conduction of water under pressure passes entirely through the hollow shaft. An insertion bushing extends in the hollow shaft and is supported by a ring-shaped flange. A labyrinthine split packing is installed between the insertion bushing and the hollow shaft.

BACKGROUND OF THE INVENTION

An example of a nozzle head is disclosed in DE 38 12 132 C2, in which the driving force arises from the recoil of the water under pressure exiting from the nozzle and the rotational motion of the nozzle holder is stopped by means of a brake. In this nozzle head, the spray direction is fixed. The insertion bushing lying along the central channel of the hollow shaft protruding from the pressure water fitting is taken up by a bore hole continuing in the central channel of the hollow shaft.

Examples of ring grooves forming part of a labyrinth gap seal in a nozzle head can be found in U.S. Pat. Nos. 4,923,120 and 5,060,863.

SUMMARY OF THE INVENTION

The present invention overcomes the problem of creating a nozzle head, of the above-mentioned type, in such a way that the locking parts, in the region of the hollow shaft, can be replaced, and the nozzle holder can have nozzles whose direction of spray can be chosen at will.

This problem is solved according to the present invention with the provision of two surrounding bushings with a planar closure in the central channel of the hollow shaft along its entire length or part of its length, placement of a split labyrinthine packing in the overlapping area between the bushings, and the possibility of driving the hollow shaft by a motor. A brake mechanism is eliminated by motorizing the drive of the nozzle holder, and the direction of the nozzle's spray can be aimed parallel to the axis of rotation, at an angle with respect to the axis of rotation or opposite to the direction of the nozzle holder's direction of rotation.

The two planar-closing bushings can be manufactured as insertion bushings, so that the bushings are placed against the faces of the hollow shaft and thus can be easily replaced, to the extent that these bushings require replacement due to wear occurring in use.

An electric, hydraulic or pneumatic motor can be used as the driving motor. It is also conceivable to install a motor taken from a chamber and drawn through channels.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawing and wherein the drawing figure is a sectional view of the nozzle head assembly according to the present invention.

DETAILED DESCRIPTION OF THE EXEMPLARY EMBODIMENTS

Referring to the drawing figure, the nozzle head 1 has a housing 2 that is bounded on one end by an end plate 3 and on the other end by an end plate 4. In the figure, the end plate 3 is of one piece construction with the housing cover. The other end plate 4 is propped against a circular spring 4' and is locked into the housing by a locking ring 5.

Beatings 6 and 7 are installed in the end plates, into which a hollow shaft 8 is installed so it can rotate within the housing 2. The hollow shaft 8 has a central channel 9. The inside diameter of this central channel 9 is preferably substantially constant throughout its entire length.

The end plate 3 is provided with a pressure water fitting 10. An insertion bushing 11 in the central channel 9 with a ring flange 12 on its end is passed through this pressure water fitting 10 and rests upon a bearing surface 13 of the end plate 3.

The insertion bushing 11 includes a part 14 having an outside diameter corresponding to the inner diameter of the channel 9, and a part 15 having an outside diameter that is smaller by about double the thickness of the wall of a second insertion bushing 16 than the outside diameter of part 14.

The second insertion bushing 16 closely surrounds part 15 of the first insertion bushing 11, in which a labyrinthine split packing is set into a ring groove in part 15. In this manner, a split labyrinthine packing is disposed in the overlapping area between the bushings, and between the insertion bushing and the hollow shaft 8.

The second insertion bushing 16 is equipped with a ring flange 17 on its end which is propped against the end of the hollow shaft that is connected to a nozzle holder 18. On this nozzle holder 18, nozzles 19 are installed, to which water under pressure is supplied through the central channel 9 and holes 20 in the nozzle holder 18. The nozzle holder 18 is secured to the hollow shaft 8 by a screw cap 21.

In the drawing, the hollow shaft 8 is illustrated as passing through the rotor 21 of an electric motor, with both of these parts being secured together. The rotor is surrounded by a stator 22, which is mounted securely in the housing 2.

The insertion bushing 11 is mounted securely within hollow shaft 8. Insertion bushing 16 turns with the hollow shaft 8 and the nozzle holder 18. Since the bushings 11 and 16 are replaceable, bushing 11 can be removed from the pressure water fitting 10 and the bushing 16 can be pulled out of the channel 9 after removal of the nozzle holder 18.

In the drawing, a chamber 23 is provided in the end plate 3 for the collection of water that may leak during use. This leaked water can be removed through channels 24.

Because of the installation of the electric motor in the housing 2 and the securing of the nozzle holder 18 onto the end of the hollow shaft 8 which projects out of the housing, the nozzle head forms a compact manufactured unit.

From the foregoing description, it will be appreciated that the present invention makes available a nozzle head having a nozzle holder, a hollow shaft connected to the nozzle holder and a pair of insertion bushings disposed within the hollow shaft and a labyrinth packing between the overlapping areas of the two bushings. The nozzle head is also designed to allow for simple operation while permitting the nozzle's direction of spray to be chosen at will.

Having described the presently preferred exemplary embodiment of a new and improved nozzle head arrangement in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

What I claim is:

1. A nozzle head comprising:

a nozzle holder, a nozzle being disposed within said nozzle holder, a fixed housing having a pressure water fitting therein, said pressure water fitting including a hollow shaft connected to said nozzle holder with a channel for communication of water under pressure passing entirely through said hollow shaft, a first insertion bushing supporting a ring-shaped flange, a second insertion bushing supporting a ring-shaped flange, said first and second insertion bushings being disposed in the channel of the hollow shaft along at least a part of its length such that said first and second bushings, at least in part, overlap, a split labyrinthine packing being disposed in the overlapping area between the first and second bushings;

an inside diameter of the channel is substantially constant over its entire length and one of the bushings has a reduced outside diameter over part of its length and the other bushing surrounding said one of the bushings in this reduced outside diameter region.

2. The nozzle head according to claim 1, wherein said first and second bushings each include their respective ring-shaped flange on one axial end and the ring shaped flange of one of the insertion bushings being disposed adjacent to the end of the hollow shaft facing the nozzle holder.

3. The nozzle head according to claim 1, wherein the hollow shaft is rotatably mounted on a pair of end plates of the housing.

4. The nozzle head according to claim 3, further comprising a chamber being disposed in one of the end plates, said one of the end plates being connected to said pressure water fitting, said chamber being in fluid communication with at least one drainage channel.

5. The nozzle head according to claim 1, further comprising an electric motor being disposed in the housing, said motor rotatably driving said hollow shaft.

6. The nozzle head according to claim 5, further comprising a stator of the electric motor being mounted on the interior of the housing and a rotor being mounted on the hollow shaft.

7. A nozzle head comprising:

a nozzle holder, a nozzle being disposed within said nozzle holder, a fixed housing having a pressure water fitting therein, said pressure water fitting including a hollow shaft connected to said nozzle holder with a channel for communication of water under pressure passing entirely through said hollow shaft, a first insertion bushing supporting a ring-shaped flange, a second insertion bushing supporting a ring-shaped flange, said first and second insertion bushings being disposed in the channel of the hollow shaft along at least a part of its length such that said first and second bushings, at least in part, overlap, a split labyrinthine packing being disposed in the overlapping area between the first and second bushings, the hollow shaft being rotatably mounted on a pair of end plates.

8. The nozzle head according to claim 7, further comprising a chamber being disposed in one of the end plates, said one of the end plates being connected to said pressure water fitting, said chamber being in fluid communication with at least one drainage channel.

9. A nozzle head comprising:

a nozzle holder, a nozzle being disposed within said nozzle holder, a fixed housing having a pressure water fitting therein, said pressure water fitting including a hollow shaft connected to said nozzle holder with a channel for communication of water under pressure passing entirely through said hollow shaft, a first insertion bushing supporting a ring-shaped flange, a second insertion bushing supporting a ring-shaped flange, said first and second insertion bushings being disposed in the channel of the hollow shaft along at least a part of its length such that said first and second bushings, at least in part, overlap, a split labyrinthine packing being disposed in the overlapping area between the first and second bushings;

further comprising an electric motor being disposed in the housing, said motor rotatably driving said hollow shaft.

10. The nozzle head according to claim 9, further comprising a stator of the electric motor being mounted on the interior of the housing and a rotor being mounted on the hollow shaft.

* * * * *